US010828691B2

(12) United States Patent
LeVey et al.

(10) Patent No.: US 10,828,691 B2
(45) Date of Patent: Nov. 10, 2020

(54) ROLL FORMING MACHINE WITH RECIPROCATING DIES

(71) Applicant: Illinois Tool Works Inc., Glenview, IL (US)

(72) Inventors: Kenneth R. LeVey, Winfield, IL (US); Thomas S. King, St. Charles, IL (US); Michael J. Marchese, III, Chicago, IL (US); Daniel A. Dechant, Richmond, TX (US)

(73) Assignee: Illinois Tool Works Inc., Glenview, IL (US)

( * ) Notice: Subject to any disclaimer, the term of this patent is extended or adjusted under 35 U.S.C. 154(b) by 235 days.

(21) Appl. No.: 15/882,506

(22) Filed: Jan. 29, 2018

(65) Prior Publication Data

US 2018/0147620 A1 May 31, 2018

Related U.S. Application Data

(63) Continuation of application No. 14/775,788, filed as application No. PCT/US2014/025060 on Mar. 12, 2014, now Pat. No. 9,919,355.

(Continued)

(51) Int. Cl.
*B21H 3/04* (2006.01)
*B21H 3/06* (2006.01)

(Continued)

(52) U.S. Cl.
CPC ..... *B21H 5/027* (2013.01); *B21H 3/06* (2013.01); *B21H 9/02* (2013.01)

(58) Field of Classification Search
CPC . B21H 3/00; B21H 3/02; B21H 3/022; B21H 3/025; B21H 3/027; B21H 3/04;

(Continued)

(56) References Cited

U.S. PATENT DOCUMENTS 387,184 A 7/1888 Rogers
3,183,697 A 5/1965 McCardell (Continued)

FOREIGN PATENT DOCUMENTS

CN 202539440 U 11/2012
CN 102844130 A 12/2012

(Continued)

OTHER PUBLICATIONS

International Search Report and Written Opinion for PCT/US2014/025060 dated Sep. 22, 2014, 10 pages.

(Continued)

*Primary Examiner* — Peter Dungba Vo
*Assistant Examiner* — Joshua D Anderson
(74) *Attorney, Agent, or Firm* — Quarles & Brady LLP

(57) ABSTRACT

A reciprocating die roll forming machine for forming a pattern such as a thread form on the outer surface of a cylindrical blank includes at least one set of reciprocating dies operating upon the blank which rotates in place. The machine includes a slide and bearing combination to support the dies belt driven by a servo-motor controlled by a central processing unit. Mechanism is provided to deliver and position a blank for engagement by the dies. In one form, the machine includes multiple die sets to produce multiple parts during one die reciprocation cycle. In another form, the machine employs separate drive mechanisms to independently drive each die of a set.

20 Claims, 9 Drawing Sheets

Related U.S. Application Data

(60) Provisional application No. 61/803,855, filed on Mar. 21, 2013.

(51) Int. Cl.
*B21H 5/02* (2006.01)
*B21H 9/02* (2006.01)

(58) Field of Classification Search
CPC ..... B21H 3/06; B21H 3/065; B21H 5/027; B21H 7/14; B21H 7/18; B21H 7/182; B21H 7/187; B21H 9/00; B21H 9/02; B21K 1/44; B21K 1/54; B21K 1/56; B21D 43/02; B21D 43/027; B21D 43/16; B21G 3/32
USPC ..... 72/67, 68, 80, 81, 88, 90, 94, 95, 103, 72/105, 109, 111, 370.16, 370.18, 370.21, 72/469, 703, 296, 306, 307, 373, 374, 72/375, 376, 405.02, 407, 419, 420, 422, 72/424, 426, 427, 428, 441, 442, 446, 72/470, 472; 470/8, 9, 10, 11, 58, 66, 70, 470/84, 85, 125, 154, 141, 164, 176, 177, 470/178, 180
See application file for complete search history.

(56) References Cited

U.S. PATENT DOCUMENTS

| | | | | |
|---|---|---|---|---|
| 3,793,866 | A | 2/1974 | Anderson et al. | |
| 4,646,549 | A * | 3/1987 | Saito | B21H 5/027 72/469 |
| 4,677,837 | A * | 7/1987 | Jackson | B21H 3/06 193/38 |
| 4,712,410 | A | 12/1987 | Killop | |
| 6,248,020 | B1 | 6/2001 | Morath et al. | |
| 6,301,945 | B1 | 10/2001 | Roseliep | |
| 2002/0013178 | A1 * | 1/2002 | Kato | B21H 3/06 470/57 |
| 2006/0162409 | A1 * | 7/2006 | Kreissig | B21H 5/027 72/88 |
| 2013/0022427 | A1 | 1/2013 | Yamanaka et al. | |
| 2013/0102401 | A1 * | 4/2013 | Hudson | B21H 3/022 470/11 |

FOREIGN PATENT DOCUMENTS

| | | | |
|---|---|---|---|
| DE | 10028165 | A1 | 12/2001 |
| JP | S6163337 | U | 4/1986 |
| JP | H05245572 | A | 9/1993 |

OTHER PUBLICATIONS

Notification of Reason for Refusal issued in corresponding Korean Patent Application No. 10-2015-7016765, dated May 1, 2020, 18 pages.

* cited by examiner

ROLL FORMING MACHINE WITH RECIPROCATING DIES

CROSS REFERENCE TO RELATED APPLICATIONS

This application is a continuation of U.S. application Ser. No. 14/775,788 filed Sep. 14, 2015, now U.S. Pat. No. 9,919,355, which is a National Phase of PCT/US2014/025060 filed Mar. 12, 2014, which claims priority to U.S. Provisional Application No. 61/803,855 filed Mar. 21, 2013, all of which are hereby incorporated by reference in their entireties.

BACKGROUND

This disclosure relates to roll forming, pattern rolling machines that employ symmetrical, reciprocating dies. It further relates to mechanism that imparts the pattern upon an otherwise unsupported blank captured between the die faces.

Cold forming of a thread, gear tooth or other pattern upon a cylindrical blank utilizing reciprocating, symmetrical dies represents known technology. Examples are found in U.S. Pat. Nos. 387,184; 3,793,866 and 4,712,410. Such machines have not achieved any significant long-term commercial success. Some are complex and cumbersome.

Machine screws with rolled threads are widely used in industry. They are typically formed using known flat die technology in existence for many years. The commonly used flat rolling dies include a stationary (short) die on a stationary platen and a reciprocating (long) die on a reciprocating slide arranged in face-to-face relation. The machine drive advances the moving die to create the thread form. Though reliable, these machines require experienced operators to setup and run. The thread rolling machines most commonly used today represent technology developed long ago, with heavy metal components subject to wear and often requiring expensive repairs.

Moreover, the foregoing thread rolling machines include an insertion finger that positions a blank between the die faces such that advancement of the moving die captures the blank for linear movement through the die faces to impart the thread form. Synchronization of the thread forming patterns on the die faces with initial insertion of the blank between the faces is a critical aspect of thread forming. The machines employed include various adjustment elements to permit refinement of these critical relationships.

The mechanism of the insertion finger represents a major element of the current thread forming equipment. Machine maintenance, as well as repair and replacement of these components adds considerably to the overall cost of commercial fastener manufacturing.

The present disclosure is directed to cold forming equipment of advanced design utilizing aspects of currently available technology, such as servo-motors, belt drives, light weight slides operating on re-circulating bearings and symmetrical, reciprocating dies. Implementation of the disclosed equipment should revolutionize cold forming of threaded fasteners and other similarly manufactured cylindrical, patterned products.

SUMMARY OF THE DISCLOSURE

The rolling machine disclosed here uses reciprocating, symmetrical, flat tooling to form a pattern on a cylindrical blank. Though illustrated as a thread forming machine, the principles disclosed are applicable to forming any pattern upon a cylindrical blank.

In the representative embodiments, die faces are configured with a thread pattern to form threads onto a cylindrical blank rolled between the dies. The use of symmetrical tooling allows both dies to move at the same time, which decreases the cycle time to complete the processing of a blank to its threaded shape. Moreover, when the blank rolls between the two moving dies, it rotates about its own longitudinal axis in a fixed position. Failure of the blank to remain in that fixed position, indicates a probable misalignment, a signal not detectable in the known process where the blank moves across the face of a stationary die.

The arrangement of the present disclosure differs significantly from the commonly used methods and the equipment now employed in successful commercial production of cylindrical patterned products such as screw thread fasteners. Here the process employs two identical thread forming dies that are reciprocal along a parallel path. The face profiles of each die includes the requisite shape to ensure operative contact with a blank and progressive thread formation. Significantly, the configuration of symmetrical, reciprocating dies permits employment of blank insertion mechanisms that eliminates the need for a starter finger and the complexities of die timing, starter finger insertion stroke and related difficulties.

The disclosure here comprises a reciprocating die, pattern forming machine to form a pattern on a cylindrical surface of a blank having a cylindrical pattern receiving surface, comprising, a base, a pair of slidable members reciprocal on the base and movable along paths parallel to and on opposite sides of a longitudinal plane, at least one pair of pattern forming dies each having a leading edge and a trailing edge and a pattern forming face mounted on the slidable members in facing relation, mechanism to deliver and position a blank between the leading edges of the dies when the leading edges of the dies are spaced apart a distance greater than the diameter of the cylindrical pattern receiving surface, drive mechanism for the slidable members to reciprocate the dies between fully retracted and fully inserted positions, the faces of the dies arranged to simultaneously engage the cylindrical pattern receiving surface of the positioned blank on diametrically opposite surfaces of the cylindrical pattern receiving surface, axial translation of the dies from the fully retracted position to the fully inserted position causing the blank to rotate about its longitudinal center between the pattern forming faces to impart the pattern upon the cylindrical pattern receiving surface, the dies arranged to support the blank during axial translation of the dies toward the fully inserted position.

In this regard a method of forming a pattern on a blank having a cylindrical pattern receiving surface is disclosed, comprising: providing a pair of pattern forming dies each having a leading edge and a trailing edge and a pattern forming face mounted in facing relation for reciprocal movement between a fully retracted and a fully inserted position on opposite sides of a longitudinal plane, positioning the longitudinal center of the cylindrical pattern receiving surface of the blank in the longitudinal plane equidistant from the leading edges of the dies, simultaneously engaging the faces of the dies with the blank at the cylindrical pattern receiving surface at diametrically opposite surfaces on the cylindrical pattern receiving surface, axially translating the dies toward the fully inserted position causing the blank to rotate about its longitudinal center to impart the pattern to the cylindrical pattern receiving surface of the blank, and supporting the blank by engagement of the pattern forming faces of the dies with the pattern receiving surface of the blank during axial translation of the dies.

The disclosure includes a reciprocating die roll forming machine for forming a pattern such as a thread form on the outer surface of a cylindrical blank and includes at least one set of reciprocating dies operating upon the blank which rotates in place. The machine includes a slide and bearing combination to support the dies belt driven by a servo-motor controlled by a central processing unit. Mechanism is provided to deliver and position a blank for engagement by the dies. In one form, the machine includes multiple die sets to produce multiple parts during one die reciprocation cycle. In another form, the machine employs separate drive mechanisms to independently drive each die of a set.

DESCRIPTION OF THE DRAWINGS

Turning to FIG. 1, the reciprocating die roll forming machine 100 of the present disclosure is illustrated in perspective view. For clarity the machine and its function are described in the context of forming a threaded machine screw from an elongate blank designated 200 in the accompanying drawings. In these drawings, for clarity of description the head of the blank 200 is eliminated and only the shank having an outer cylindrical surface to be threaded is shown. The disclosed roll forming machine however and its components are useful for any pattern forming on a cylindrical blank.

Figure 1:
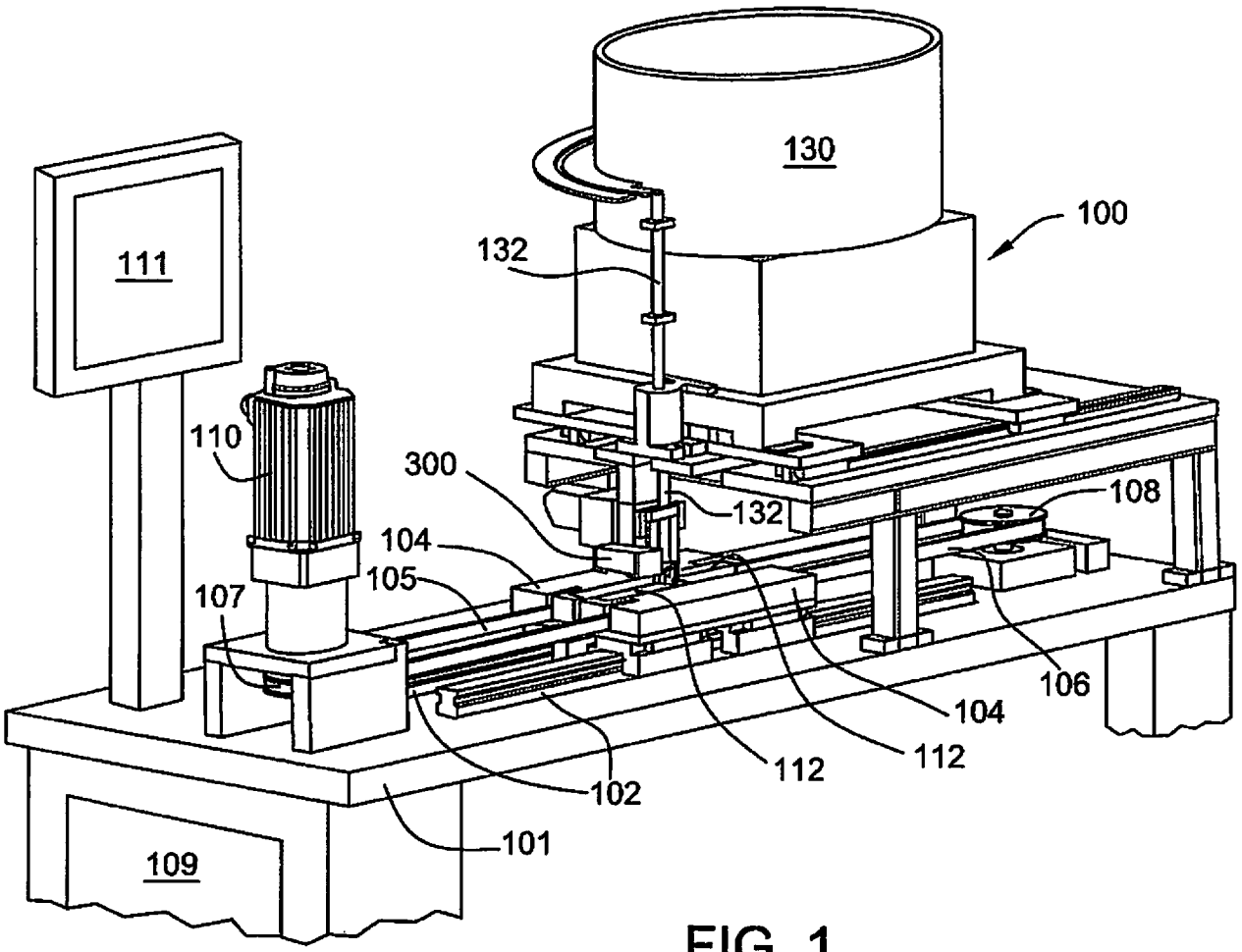
FIG. 1 is a perspective view of a reciprocating die roll forming machine incorporating the principles of the present disclosure.

Machine 100 includes a pair of stationary elongate rails 102 supported on a base 101. Each rail supports a reciprocal slide block 104 with recirculating ball bearings. Slides 104 each carry a forming die 112. Notably, the slides 104 and rails 102 are sufficiently sized to receive the lateral or transverse loading associated with the deformation of the blanks during thread rolling.

The slides 104 are connected for reciprocal movement upon rails 102 by a pair of toothed belt segments 105 and 106. Segment 105 passes around a toothed pinion 107 driven by reversible servo-motor 110 mounted on base 101. Segment 106 extends around idler pulley 108 rotatably supported on base 101. Forward and reverse rotation of servo-motor 110 causes the belt segments 105 and 106 to axially translate the reciprocate slides 104 upon rails 104. The operation of servo-motor 110 is controlled by a central processing unit (CPU) 109 responsive to software that receives instruction from an operator touch screen panel 111.

Input from the operator station 111 can position the slides 104 (and hence dies 112) as needed to insure that forming upon a blank commences at the working center of the process. With the dies properly aligned relative to the blank to be formed and to each other, to impart a desired pattern on the outer surface of the blank. The input controller can also set the length of path of the reciprocating slides 104 and control all other functions of the machine.

Reversible servo-motor 110 provides the driving force. Notably, the construction of the machine 100 is such that manual manipulation of the belts 105 and 106 may be employed to move the slides 104. Such is the versatility of the servo-motor 110. Also, it is contemplated that a single machine may include multiple slide blocks with die sets along the rails 102 connected for simultaneous operation by servo-motor 110. In such an arrangement multiple parts may be formed simultaneously.

In this disclosure, reference to "longitudinal" means along the path of travel of the moving dies. "Transverse" means perpendicular to the working faces of the dies. "Forward" means longitudinally in the direction of thread rolling and "rearward" means in the opposite direction.

Figure 2:
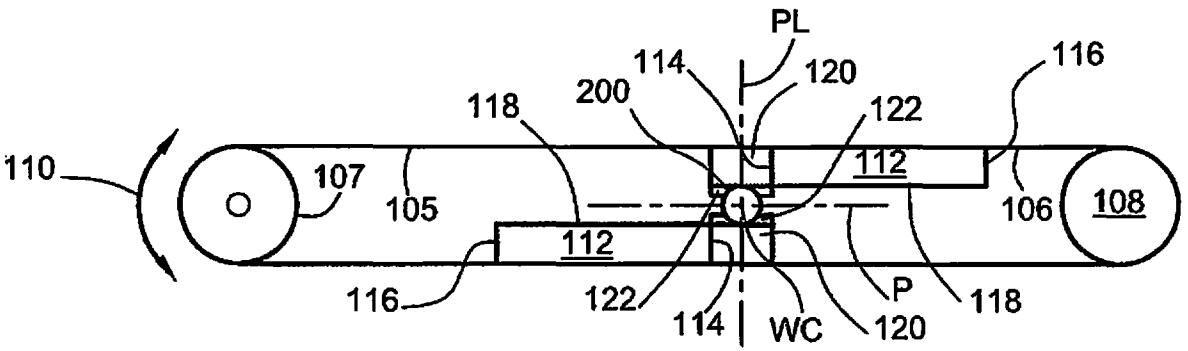
FIG. 2 is a schematic view of the roll forming machine of the present disclosure showing the symmetrical reciprocating dies in an initial, or retracted position
Figure 3:
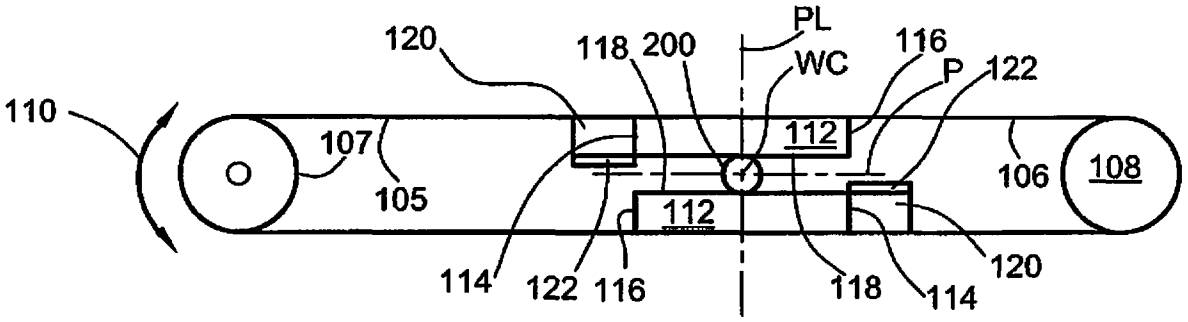
FIG. 3 is a schematic view similar to FIG. 2 showing the symmetrical reciprocating dies in an intermediate position.
Figure 4:
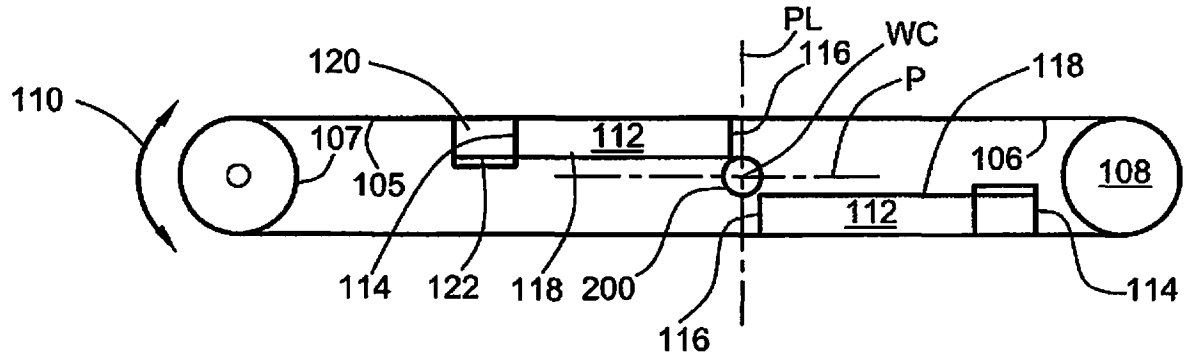
FIG. 4 is a schematic view similar to FIGS. 2 and 3 showing the symmetrical reciprocating dies in a final or inserted position.

FIGS. 2 to 4 schematically illustrate the configuration of a set of symmetrical, reciprocating dies of the present disclosure arranged to roll a spiral thread (or other desired pattern) on a cylindrical blank. The disclosed arrangement is of course suitable to cold form any repetitive pattern on the outer surface of a cylindrical blank.

The dies, designated 112 are mounted in machine 100, on slides 104 that longitudinally travel on rails 102, to reciprocate between a fully retracted, or loading position, represented in FIG. 2 to a fully inserted or discharge position illustrated by FIG. 4.

At the rearward extent of travel (retracted position) the leading edges, 114 of the dies 112 are spaced apart a distance sufficient to insert a cylindrical blank 200 into the space between the leading edges. At the fully inserted position of the dies, the trailing edges 116 of the dies surpass each other and are spaced apart a distance sufficient to discharge a formed part. Thus the length of the path of travel of each die somewhat exceeds the longitudinal length of each of the dies. Note that the illustrated reciprocating dies are oriented vertically. The blank is similarly positioned with its longitudinal axis disposed vertically. This orientation lends itself to vertical feed for loading and discharge of the blank between the reciprocating dies 112. Other orientation of the dies such as horizontal may also be employed.

The die faces 118 containing the pattern to be imparted to the blank are disposed in opposed facing relation and traverse a parallel path of reciprocation between retracted and inserted positions equidistant from and on opposite sides of a vertical longitudinal plane P. The die faces 118 include a pattern of thread forming ridges to impart the thread form to the outer cylindrical surface of blank 200. The die faces 118 are positioned in face-to-face relation, spaced apart a distance such that the forming pattern on each die engages the outer surface of an interposed blank 200. The "working center" of the forming process resides in plane P and is designated WC in the drawings. It is located at the intersection of a transverse plane PL, equidistant from the leading edges 114 of dies 112, and hence, from the die face patterns.

Normal dies for making machine screws are designed with a constant cross section, or machined depth of thread. In order to form correctly, the machine setup operator must make adjustments in the machine to angle the dies. This allows a blank to be gradually formed over the entire faces of the dies. For this reason, different operators achieve different die life depending on their setup experience. Here, optionally the die faces may be made with the thread pattern converging toward the plane P from leading edges 114 to trailing edges 116. That is, the thread form or pattern on the faces of each die is formed from leading edge 114 to trailing edges 116 at an angle converging toward plane "P" such that blank deformation increases from the leading edge to the trailing edge. The length of each die between its leading edge 114 and trailing edge 116 is sufficient for the blank 200 to complete four to five revolutions as it is rolled between the moving die faces.

Alternatively, it is contemplated that the dies be made with a constant machined depth as in other known roll forming machines. The requisite convergence of the die faces 118 toward the longitudinal plane P from the leading edges 114 to the trailing edges 116 is accomplished by placing shims between the back face of each die and its associated slidable bearing block 104. These alternative forms of die manufacture and installation may be used for the dies employed in all embodiments of this disclosure.

The cylindrical blank 200 to be threaded in FIG. 2, is positioned with its longitudinal center line at the working center WC of the process equidistant from the leading edge 114 face 118 of each die. As the dies progress from the fully retracted position toward the fully inserted position, the die face patterns at leading edges 114 simultaneously engage the blanks at diametrically opposite surfaces along transverse plane of contact "PL" perpendicular to longitudinal plane P passing through the working center of process WC.

The thread form pattern on the die faces is oriented such that the pattern on a die face is displaced one hundred eighty degrees (180°) relative to the other die face. This relationship is, of course, necessary to impart the appropriate deformation to the blank.

In a properly aligned relationship, the blank 200 rotates about the blank longitudinal center at the working center of the process WC and remains longitudinally stationary relative to longitudinal plane P. If, during rolling of a thread pattern, longitudinal movement of the blank occurs, it is an indication that there is a malfunction and that unsatisfactory results are occurring.

Figure 6:
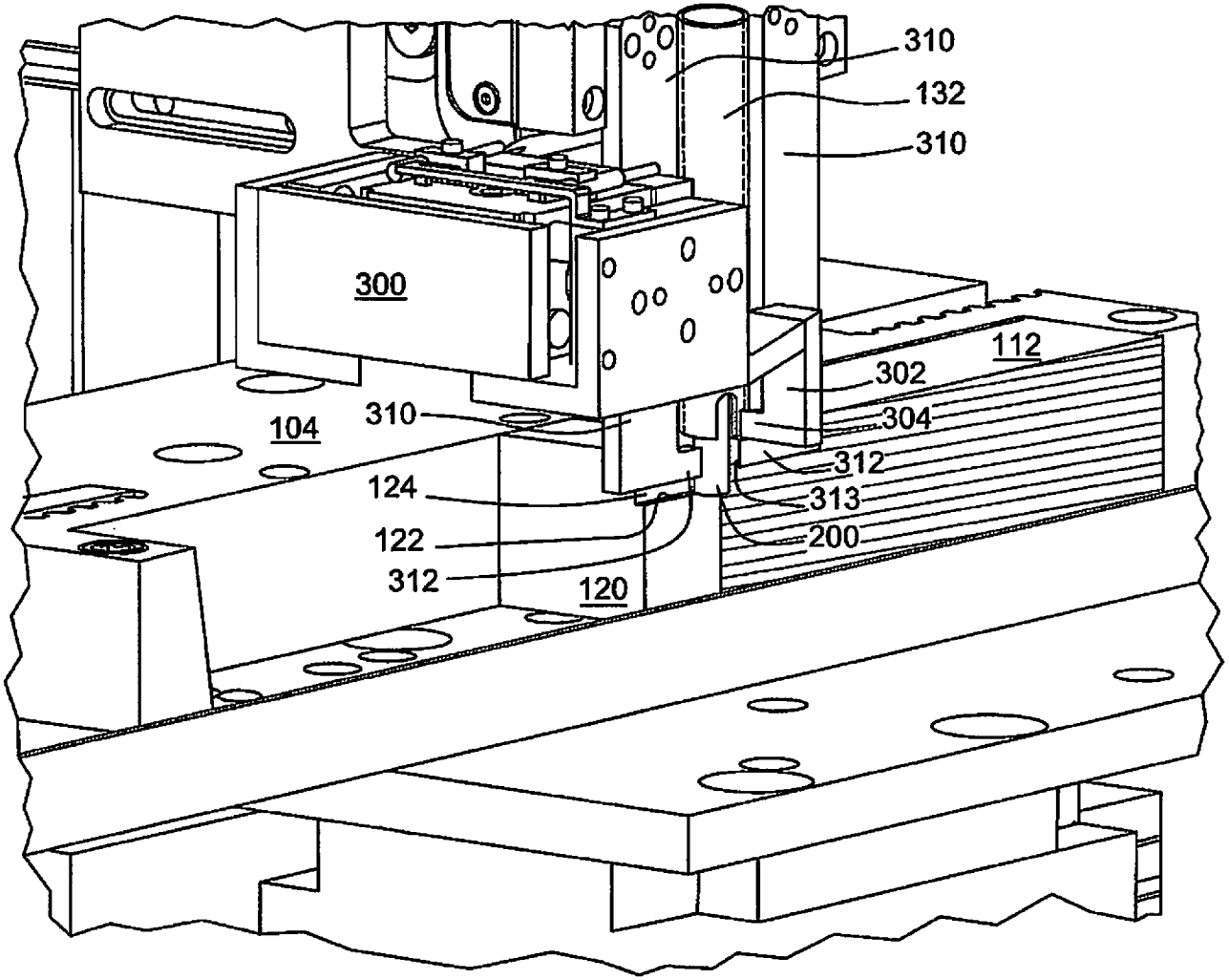
FIG. 6 is a partial side view of the apparatus of FIG. 1, illustrating further details of the blank feeding mechanism.

As illustrated schematically in FIG. 2, when the dies 112 are in the fully retracted position the leading edges 114 are spaced apart a distance greater than the diameter of the blank to be formed. For purposes of positioning and retaining a blank 200 in place until contact is made by the leading edges 114 of the dies with the outer cylindrical surface of the blank at transverse plane PL, each die 112 is provided with a support block 120 longitudinally forward of leading edge 114. Support blocks 120 are best seen in FIG. 6. They are configured to cooperate with a given blank (length and diameter) to support the blank before it is captured between the faces 118 of the reciprocating dies 112 at leading edges 114. In this regard, each support block 120 includes a horizontal stop surface 122 positioned at a depth relative to the top of each die 112 such that a blank deposited between blocks 120 comes to rest with the entire surface to be formed positioned below the upper edge of the die faces 118. This is particularly important in forming machine screws which usually include an enlarged head portion above a shank.

As illustrated in FIGS. 2 to 4, horizontal stop surfaces 122 extend transversely inward toward plane P a distance sufficient to support a blank 200, but spaced apart sufficiently to pass each other during the forming operation. Support blocks 120 each also include a vertical guide face 124 facing toward plane P and hence toward each other. Faces 124 are spaced apart sufficiently to receive a vertically oriented blank and maintain its longitudinal center aligned with plane P, equidistant from each die face 118. Thus when a blank 200 is permitted to be inserted (by gravity) between support blocks 120 it is vertically positioned by horizontal stop surface 122 and transversely positioned by vertical guide faces 124 such that the initiation of the forming operation by engagement of dies 118 with the exterior surface of the blank will occur with the blank properly oriented relative to die faces 118 and plane P. A final orientation of the blank relative to the leading edges 114 of dies 112 occurs on engagement of the blank by blank delivery mechanism 300 explained in detail below.

As seen in FIG. 3, as the dies 112 move toward each other along the path defined by plane P, the die blank 200 becomes captured and supported between the dies. As the blank 200 contacts both dies it commences to rotate about its longitudinal center due to contact of its outer surface with the faces 118 of both dies.

As movement of the dies 112 continues toward the fully inserted position, the die faces pass each other on plane P. The blank remains in a fixed location rotating about its vertical center as the dies engage its outer peripheral surface. The thread forming dies deform the peripheral surface of the blank 200 to form the thread pattern. This progression between the dies 112 is illustrated in FIG. 3.

FIG. 4 illustrates the conclusion of the thread forming process of machine 100. Here, the rolling dies 112 have traveled to the forward terminus of their reciprocal path along plane P. The die spacing is such that the die faces 118 are spaced from the outer peripheral surface of the now completed threaded fastener (formerly blank 200). It is free to fall into an appropriate collection container (not shown).

In development of the mechanism disclosed herein, several factors have been determined to be critical to satisfactory roll formed thread creation. Significantly, the blank must be disposed at the working center WC with the blank longitudinal center coaxial with the machine working center WC. The dies must both engage the blank at surfaces one hundred eighty degrees (180°) apart, at plane PL to properly synchronize pattern formation at two diametrically opposed lines of contact with the blank, 180° apart.

Seen in FIG. 1 the machine 100 includes a blank supply container 130 with a vertical supply tube 132 supported above the upper edge of the dies 112 aligned with the working center of the process WC (in FIGS. 2 to 4). Blanks 200, to be formed, are stacked vertically, one above the other, in tube 132 from where they drop, one per cycle of reciprocation of the dies, into position for forming, by the die faces 118.

Figure 5:
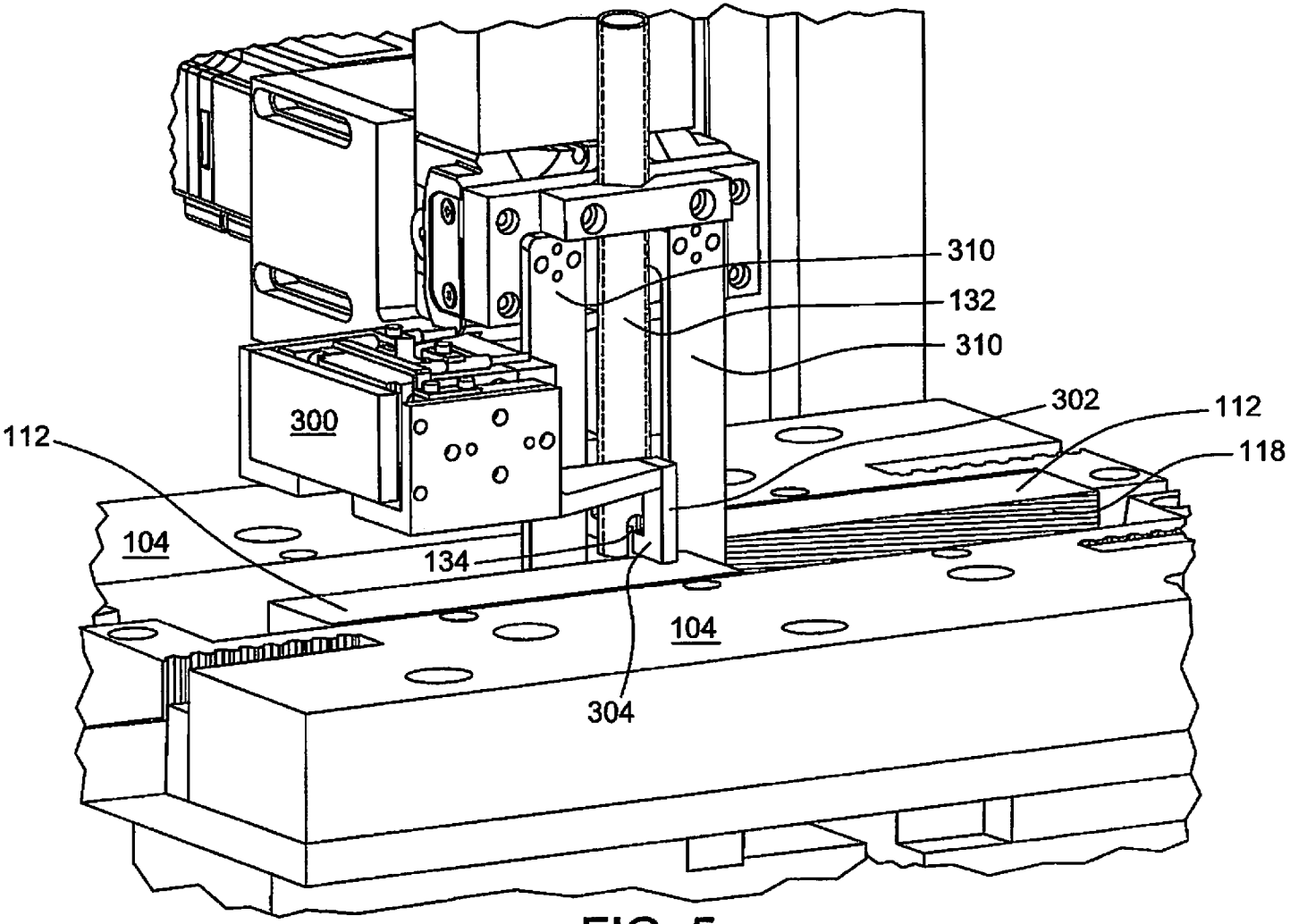
FIG. 5 is a perspective view of a portion of the apparatus of FIG. 1, on an enlarged scale, showing details of a blank feeding arrangement of the illustrated roll forming machine.

FIG. 5 illustrates the lower end of vertical supply tube 132. It includes two slots 134 positioned 180° apart on transverse plane of contact PL of FIGS. 2 to 4. Slots 134 permit access to a blank 200 positioned within the tube 132 for purposes as will be explained.

Figure 7:
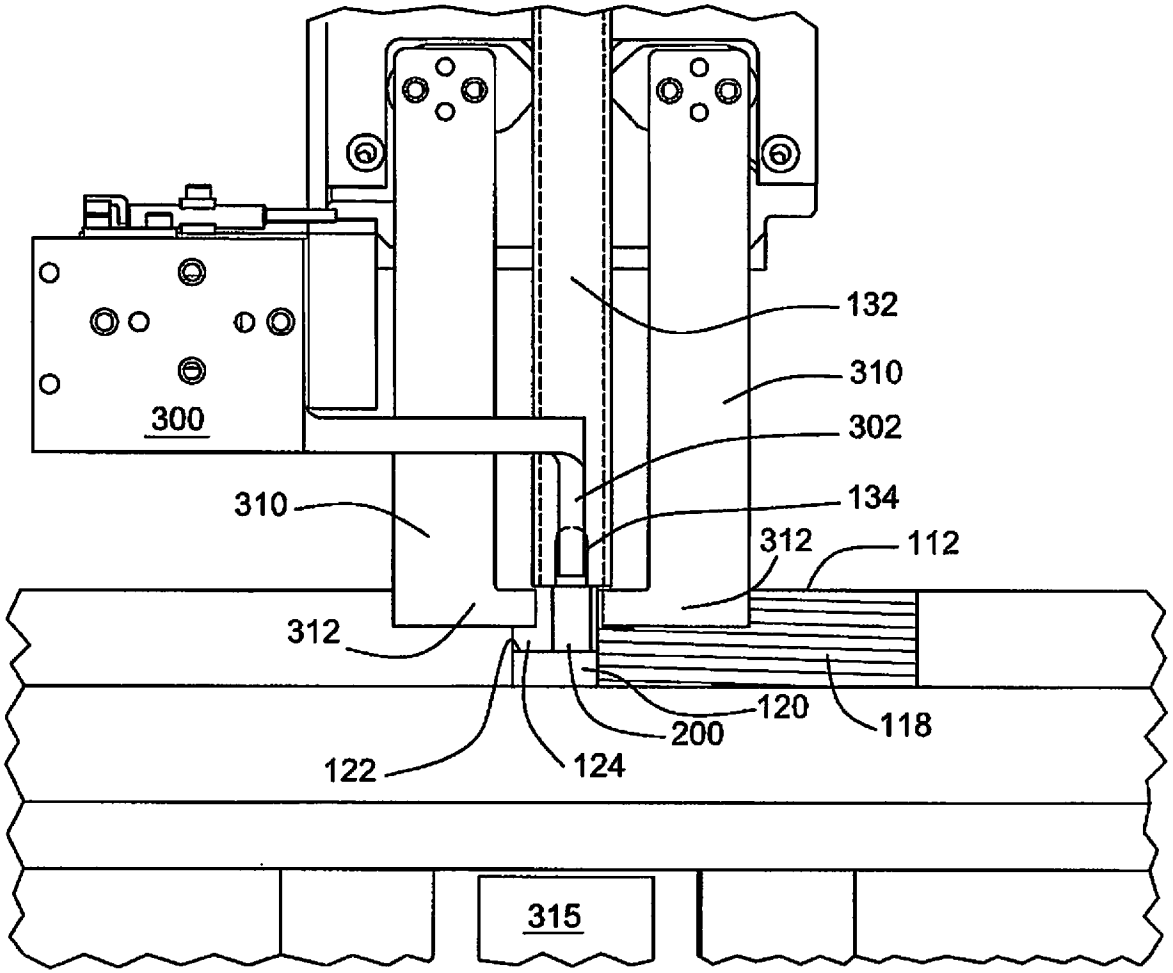
FIG. 7 is a partial side view of the apparatus of FIG. 1 illustrating further details of the blank feeding mechanism.

The machine 100 includes a blank delivery and positioning mechanism generally 300, seen in FIG. 1 and in further detail in FIGS. 5 to 7. It is supported above reciprocating slides 104. Mechanism 300 acts on blanks stacked within supply tube 132 to deliver a single blank for form rolling between dies 112 on each machine cycle. A machine cycle is one complete reciprocation of slides 104 carrying dies 112 between a fully retracted position (FIG. 2) to a fully inserted position (FIG. 4) and back to a fully retracted position (FIG. 2). Blank delivery and positioning mechanism 300 operates at the initial portion of the cycle to deliver and position one blank 200 for processing during each cycle.

Delivery and positioning mechanism 300 is solenoid operated. Its function and timing is coordinated by the CPU (computer) 109 and associated software to synchronize with reciprocation of slides 104 and dies 112.

Delivery and positioning mechanism 300 includes a pair of transverse arms 302 with catch fingers 304 aligned with slots 134 in vertical supply tube 132. Transverse arms 302 are pivotally supported on mechanism 300 with catch fingers 304 positioned above the top of die 112. They are normally biased toward each other to retain a blank 200 at the bottom end of the tube 132 and prevent it from exiting the tube (See FIG. 7). The transverse catch fingers 304 enter slots 134 and include ends that make contact with the vertical cylindrical surface of the bottom-most blank 200 in the tube 132.

Blank delivery and positioning mechanism 300 also includes a pair of locating arms 310 with facing locating fingers 312. Locating arms 310 are pivotally supported on mechanism 300 for movement of locating fingers 312 toward and away from each other along longitudinal plane P. They may be biased to a normally open or spread position. The free ends 313 of locating fingers 312 are spaced apart a distance greater than the diameter of the outer cylindrical surface of blanks 200 and are curved to cooperate with the outer cylindrical surface of blanks. Notably, and as best seen in FIG. 6 or 7, locating fingers 312 and facing ends 313 operate below the top surface of dies 112 and support blocks 120. Thus, the thickness of locating arms 310 and locating fingers 312 must be less than the transverse spacing between the vertical guide surfaces 124 of support blocks 120 and faces 118 of dies 112.

The sequence of operation of the blank delivery and position system is as follows, recognizing that blank delivery occurs during the portion of the cycle of die reciprocation when the leading edges 114 of the dies are spaced apart sufficiently to receive a blank 200 (FIG. 2). Notably, during this portion of the cycle, support blocks 120 are positioned adjacent the working center of the process WC to receive and support a delivered blank 200.

Delivery of a blank 200 is initiated by release of the bottom blank 200 in the vertical stack of blanks within vertical supply tube 132. This occurs on activation of transverse arms 302 to momentarily withdraw catch fingers 304 from slots 134 at the bottom end of vertical supply tube 132. A blank 200 is released and falls vertically between vertical guide faces of 124 of support blocks 120. Such vertical descent is limited by contact of the bottom of the blank 200 with the horizontal stop surfaces 122 of support blocks 120. This relationship is illustrated in FIGS. 6 and 7. Transverse arms 302 are immediately permitted to assume a normally closed position, that is, with the facing ends of catch fingers 304 within slots 134 of vertical supply tube 132 to capture the next blank 200 and support the remainder of the column of blanks.

The blank 200 released from catch fingers 304 drops between vertical guide faces 124 and comes to rest on horizontal stop surfaces 122 between the facing curved ends 313 of locating fingers 312. The mechanism 300 immediately activates the locating arms 310 to pivot toward each other. The curved surfaces of ends 313 of locating fingers 312 move toward each other and engage the outer cylindrical surface of the blank 200. Such action by locating arms 310 positions the blank at the working center of the process WC with the longitudinal centerline of the blank 200 aligned with the working center of the process WC.

The locating fingers 312 momentarily maintain the blank in position until the leading edges 114 of dies 112 engage the blank outer cylindrical surface at lines of contact 180° (diametrically) apart at transverse plane of contact PL. On such engagement at the leading edges 114 of dies 112 the blank 200 is released by locating fingers 312. That is, the locating arms 310 are activated to move the ends 313 apart and out of contact with blank 200. The blank, is positioned vertically by horizontal stop surfaces 122, transversely by vertical guide faces 124 and longitudinally by curved facing ends 313 of locating fingers 312. It is grasped by the opposed faces 118 of dies 112 at the leading edges 114 and is free to rotate about the working center of the process WC as the pattern on faces 118 of the dies 112 pass on opposite sides of the blank as the dies move toward the fully inserted position (FIG. 4). As the dies 112 reach the fully inserted position (FIG. 4), the trailing edges 116 become spaced apart sufficiently to release the formed part which falls into a receptacle 315 shown in FIG. 7 positioned below the rails 102 in vertical alignment with the working center of the process WC.

It is evident that positioning the blank 200 for contact with the forming dies 112 is critical to the successful forming of a satisfactory pattern on the outer cylindrical surface. The blank 200 must be positioned such that leading edges 114 contact opposite surfaces of the blank with the die face pattern synchronized. Also the blank must be fully vertically inserted between the dies and it must be disposed vertically in order that the complete blank be formed and with a satisfactory pattern. Toward that end, it has been found that machine vision equipment may be employed control the operations of the machine. Machine vision is a known technology that uses camera technology and comparative analysis to evaluate the operation of manufacturing equipment. Should the camera signals recognize an anomaly, an associated computer provides an output signal indicative of a malfunction. It may also be used to shut down the equipment for adjustment and to prevent introduction of unsatisfactory product into the manufacturing stream.

There are several advantages to a thread rolling machine that uses a reciprocating action on both dies rather than on a single die. There are additional benefits when using a servo-motor that reverses, to return the dies, rather than using a standard electric motor driving through a flywheel and a crankshaft.

The first is the ability to measure and understand rolling diameter, a known aspect of roll forming. The diameter upon which a blank rotates between two thread roll dies does not equal the outside diameter of the finished part or the minimum diameter of the blank. It equals a number somewhere in between, namely the rolling diameter.

The rolling diameter is created because of the friction between the surface of the die and the surface of the blank. This friction will force the blank to rotate between the two die faces and not to slide. The nature of a blank is a two dimensional cross-section normally shaped as a thread. The pressure, geometry, surface finish, set up pressure and overall friction will vary the rolling diameter. The die designer does not control all of these variables, since every setup is unique on today's commercial equipment.

The ability to move the slides of the machine a precision distance because of the servo-control permits determination of the rolling diameter of the screw. The servo-driven thread roll machine of this disclosure allows the rolling process to begin, then an exact amount moved. For observation purposes, it is possible to mark the angular position of the blank at the point the process is paused. Thereafter, the dies are moved the exact distance designed in the thread roll die "transverse pitch", the blank should rotate exactly 360°.

It is typical for all thread roll dies to rotate blanks between four and six rotations. If the angular rotation noted is not 360° an adjustment to the die can be made and measured to understand the exact transverse pitch. Once this adjustment is made, the tooling will run for a greater length of time and more efficiently. Without the use of a servo-motor a very complex secondary system would need to be in place to take the measurements described. The disclosed machine with servo drive, will actually give feedback on die design.

Another benefit of the thread roll machine of this disclosure is the use of recirculating linear bearings. Such bearings are manufactured to high tolerance and are able to withstand high loads over long periods. It is estimated that such a machine, used to manufacture M6 machine screws, would be able to manufacture screws at 250 strokes per minute for 24 hours a day for four years before maintenance is required. Moreover, such bearings can be easily replaced with simple tools at a low cost and with minimum hours of down time. Current thread forming machine ways (slides) have to be "reworked" by skilled specialists involving thousands of dollars in parts, labor and unknown downtime. In some instances, current machines must actually be removed from the factory and shipped to a rebuilder for reworking. Additionally, high speed roller bearings are much stiffer than using traditional oil film machine ways, so setups can be very consistent.

The stability gained by the use of a linear bearing gives the additional advantage of creating a parallel die pocket for thread roll tools (dies). It is customary for current equipment to have a movable pocket that is not adjustable and a stationary pocket that is adjustable. The adjustments of the stationary die are there to allow the operator to change the pressure required to manufacture the screw. The disclosed innovation of forcing the equipment to only have parallel pockets gives the advantage of engineering the thread roll tooling to have the proper adjustments built into the design and eliminating the need for an operator to make these adjustments. For example, it is typical for a standard machine screw to be manufactured with light pressure at the beginning of the roll and heavier pressure at the finish of the role. This pressure is created by physically moving the trailing edge of the die closer and the leading edge of the die further away. These adjustments take skill and experience. Removing the adjustability of the machine takes away the need for skill and experience for set up. The slight change in blank diameter and in wear of the tooling face can be adjusted by placing shims behind the die and not moving the machine at all. It also contemplated that a further machine development would include automation, described as dynamic flex, to eliminate the need for shims. Such a system would work in conjunction with automated inspection also a contemplated future addition.

The disclosed machine uses servomotors, carbon fiber belts and linear bearings to create the moving surfaces and transfer the energy through the system. An additional advantage of using this type of strategy allows for longitudinally spaced multiple tool sets in place, along the belt, all operable in a single stroke. In the typical manufacturing method with one stationary die and one moving die the stroke is one third longer than when both dies are moving. This shorter stroke lends itself to having multiple die sets on the belt arrangement such that within one stroke cycle two screws are made rather than one. The distance the machine strokes is controlled through a computer program, not a crank shaft. This permits readily switching between running small dies, large dies, or multiple dies.

Figure 8:
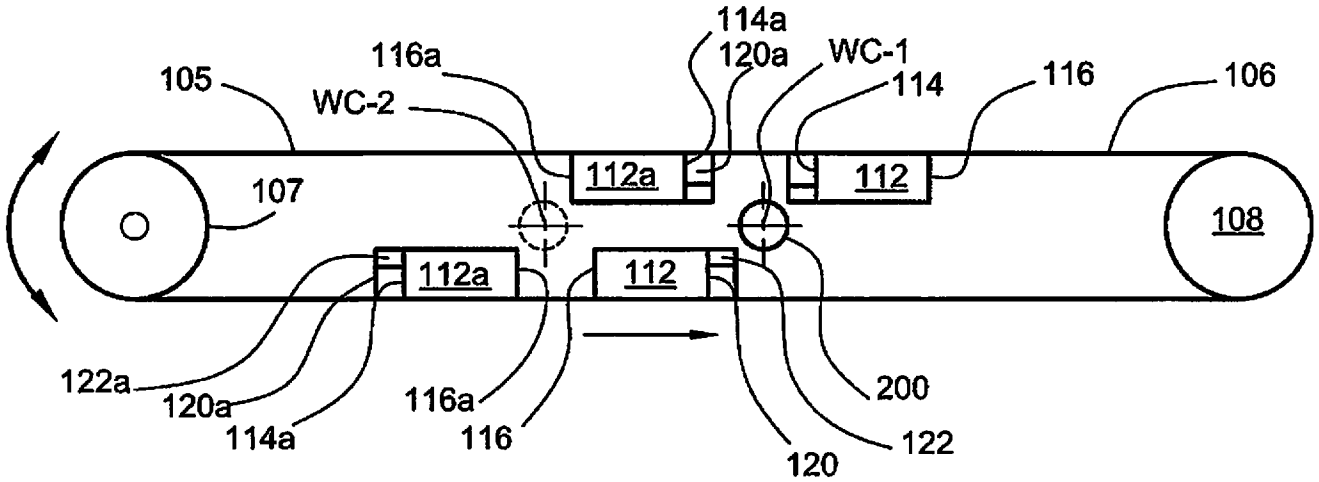
FIG. 8 is a schematic view of a modified form of the reciprocating die roll forming machine of FIG. 1 showing plural sets of roll forming dies.
Figure 9:
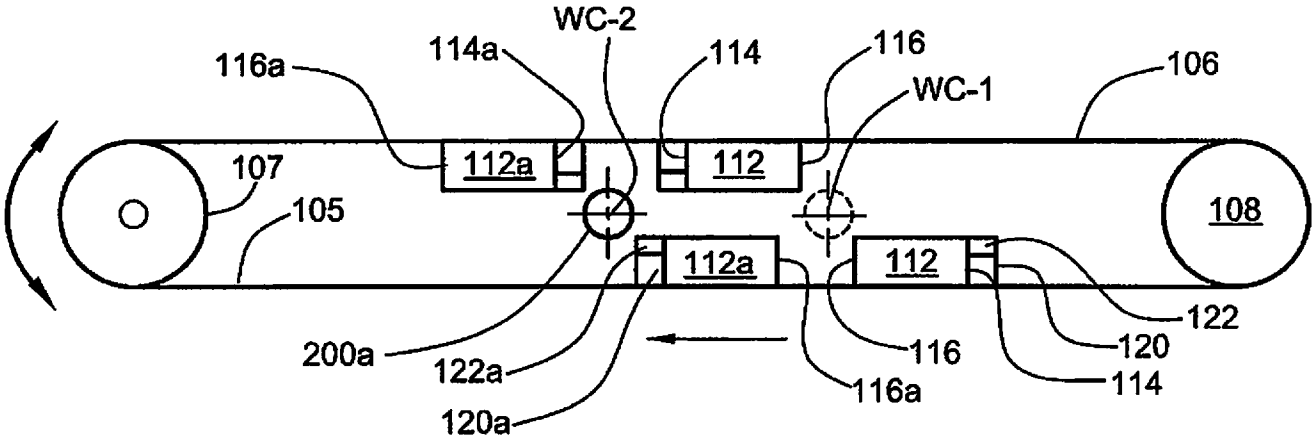
FIG. 9 is a schematic view of the modified form of reciprocating die roll forming machine of FIG. 8 showing the dies in different positions.

FIGS. 8 and 9 illustrate schematically a configuration of the roll forming machine 100 employing multiple die sets driven reciprocally by a servo-motor 110 through drive pinion 107 and controlled by a computer 109 with operator input at a panel such as the panel 111 shown in FIG. 1. The advantage derived from the arrangement here illustrated is that two parts are formed during each cycle of reciprocation of the machine.

As described in connection with the configuration discussed above in reference to FIGS. 2 to 4, toothed belt segments 105 and 106 driven by servo-motor 110 reciprocate a set of dies 112 with leading edges 114 and trailing edges 116 to form a pattern on a cylindrical blank 200 located at the center of the process WC-1.

To double the capacity of the machine, this configuration includes a second set of dies 112*a* each with a leading edge 114*a* and a trailing edge 116*a*. End die 112*a* includes a support block 120*a* at its leading edge configured as are the support blocks 120 seen in FIGS. 2 to 4 and 7. These dies 112*a* function identically to the dies 112 to form a pattern on a cylindrical blank 200*a* located as a second center of process WC-2. The dies 112*a* are arranged to act on the second blank 200*a* when the longitudinal movement of the dies is in the opposite direction as in the instance of dies 112. The two working centers of the process are spaced apart such, and the position of the leading edges 114*a* of the dies are such that the second set of dies 112*a* functions in the same manner as explained in reference to the dies 112, except when the longitudinal reciprocal movement is in the opposite direction. As can be appreciated, when blank 200 is being loaded at center of process WC-1 a completed part is being discharged at center of process WC-2.

With the arrangement illustrated in FIGS. 8 and 9, it is contemplated that two blank supply containers with vertical supply tubes are employed, one associated with each working center of process. Similarly, each station includes a blank delivery and positioning mechanism 300 to sequentially feed and position the blanks 200 and 200*a* to insure proper initiation of contact with the dies. All timing and sequence of operation will be established and controlled by the computer 109.

There are many advantages to the screw not moving longitudinally during the rolling process. It is typical in current manufacturing practices that the screw is traveling at a high rate of speed across the face of the stationary die being driven by the single moving die. In the disclosed machine, both dies move at the same rate, resulting in the blank rotating in place. The fact the blank does not take up any more space than its own cross-section allows for several improvements to be made. The first improvement is the fact that the blank is easily measured to verify the rolling process was correct. The blank should only rotate while rolling. If it moves longitudinally to the right, left, or rises, there was a problem and the process may be stopped, and appropriate adjustments made.

Using coolant, solvent, or other fluid on the face of the tooling is important in cold forming process of thread rolling. An axially stationary blank allows placement of fluid jets and hardware right next to the blank to spray the fluid exactly where needed. In typical manufacturing, the blank is moving across the entire face of the stationary die. So, the fluid is either not spraying in the right spot, or it must spray the entire longitudinal path.

Another benefit of stationary thread rolling is that blanks may be fed vertically do not have to worry about the tip of one part nesting in the head of another. The part never moves from left to right so manufacturing process can be vertical. This vertical process is a great advantage when laying out the machine to optimize floor space in a manufacturing facility.

Another benefit of using a servo-motor and a linear bearing and belt system allows us to manufacture a piece of equipment that has very little mass and very low inertia. These benefits allow us to disable the servomotor and easily, and freely move the tooling by hand. This hand operation allows there to be a great benefit when it comes to the safety of the machine operator, and speed of setup. Since the dies and other moving machine parts are the same weight and move in opposite directions, the machine is very balanced while running. Because of this, the total weight of the machine is significantly less and may be made as a bench-type device, rather than a heavy floor mounted base.

Figure 10:
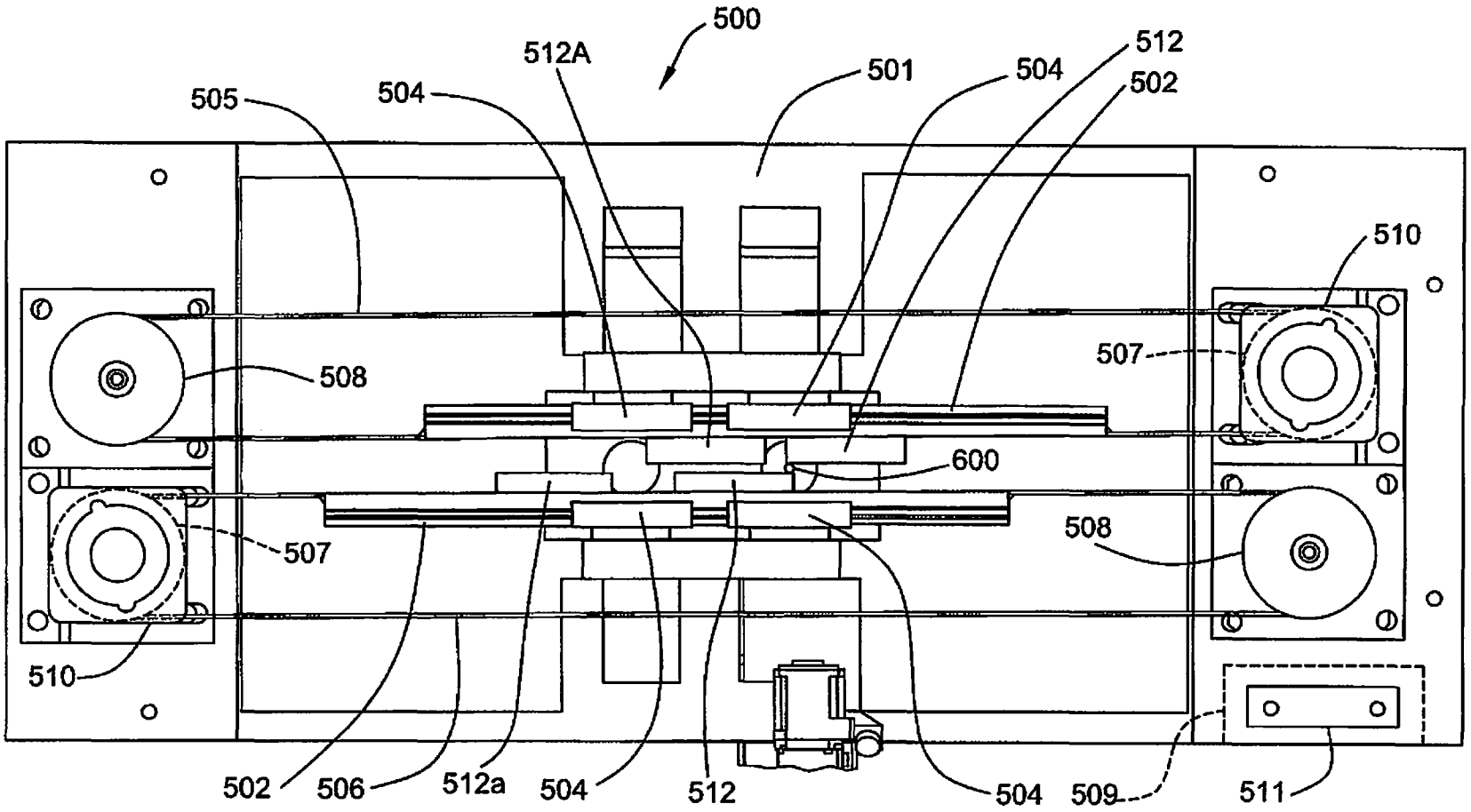
FIG. 10 is a top view of a further modified form of reciprocating die roll forming machine incorporating additional features as compared to the machine of FIG. 1.
Figure 11:
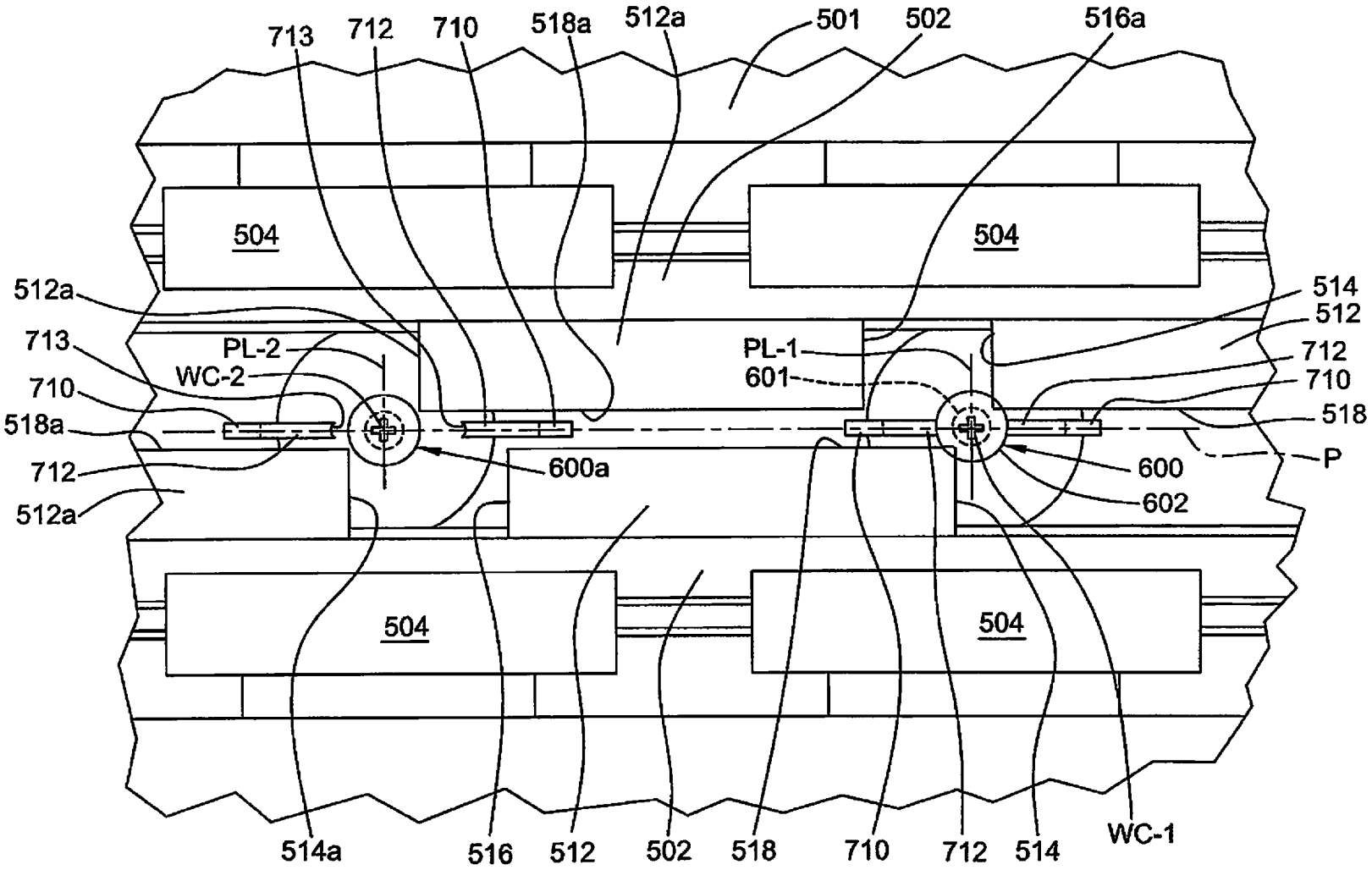
FIG. 11 is a partial top view, on an enlarged scale, of the reciprocating die roll forming machine of FIG. 10 illustrating a blank feeding arrangement.
Figure 12:
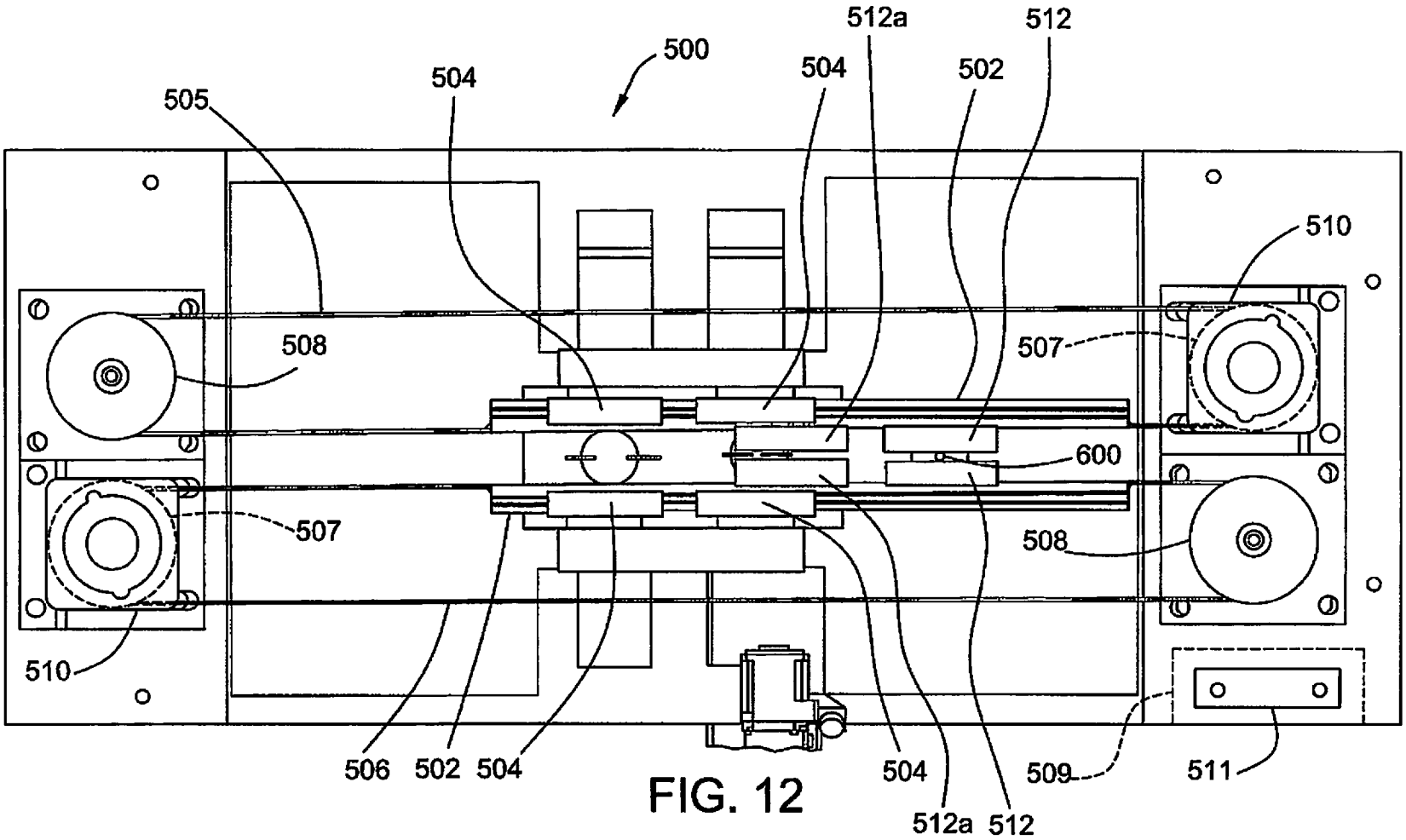
FIG. 12 is a top view of the reciprocating die roll forming machine of FIG. 10 illustrating certain advantages of this embodiment.

FIGS. 10 to 12 illustrate a modified form of the reciprocating die roll forming machine of the present disclosure. It possesses the features and advantages of the reciprocating die roll forming machines of the previous embodiments. In addition, the machine of this embodiment includes two separate servo-motor and belt drive systems, one for each die of a set. This arrangement has the capability of independent movement of the individual dies which provides advantages not otherwise available. Also this embodiment employs stationary bearing blocks and slidable die support rails which permit location of the bearings to maximize support against lateral forces attendant to roll forming.

For simplicity of understanding the basic machine operation, the illustrated embodiment is described in the context of manufacturing a threaded machine screw from a blank. The disclosed machine, however, is useful to form any desired pattern on a cylindrical blank attainable by roll forming.

Referring to FIGS. 10 and 11 the illustrated reciprocating die roll forming machine 500 includes a base 501 that supports opposed bearing blocks 504. The bearing blocks 504, in turn, support elongate rails 502 slidable along spaced paths parallel to and equidistant from longitudinal plane "P", shown in FIG. 11.

In this embodiment, the slidable rails 502 are each driven by a toothed belt 505 and 506 best seen in FIG. 10. As shown, belts 505 and 506 each include ends affixed to the ends of one of the rails 502. Belts 505 and 506 are supported on base 501 for reciprocal drive by separate, reversible servo-motors 510. Each belt 505 and 506 passes around a toothed pinion or sprocket 507 driven by one of the motors 510. Each separate belt extends around an idler pulley 508 rotatably supported on base 501. Forward and reverse rotation of either servo-motor 510 causes the associated belt to axially translate one of the slidable rails 502 supported on bearing blocks 504 independently of the other.

The operation of servo-motors 510 is controlled by a central processing unit (CPU) 509 responsive to software that receives instruction from an operator touch screen panel 511. Input from the operator station can position the slidable rails 502 as needed to insure that forming upon a blank commences with the dies 512 properly aligned relative to the blank to be formed and to each other, to impart a desired pattern on the outer pattern receiving surface of the blank. The input controller can also set the length of path of the reciprocating slidable rails 502 between a fully inserted position of the dies and a fully retracted position as well as synchronize movement of slidable rails 502 and hence dies 512 as well as control all other functions of the machine.

As in the instance of the embodiment of FIGS. 8 and 9, the reciprocating die roll forming machine of the embodiment of FIGS. 10 to 12 is configured to produce two completed roll formed products from two blanks processed sequentially in one complete cycle of operation. It should be understood, however, that the advantages attendant to the separate independent drive for each die of a pair of cooperating dies, and the use of stationary bearing blocks 504 on the machine base 501 supporting reciprocating slide rails 502 are fully attainable even when only one die set is employed and only one roll formed part is completed per machine reciprocation cycle.

FIGS. 10 and 11 illustrate the configuration of the machine 500 to cause two sets of reciprocating dies 512 and 512*a*, each to roll a spiral thread (or other desired pattern) on a cylindrical blank 600 during one reciprocation cycle. Notably, the blanks 600 illustrated include an elongate, cylindrical pattern receiving surface 601 and an enlarged head portion 602.

The dies 512*a* function identically to the dies 512 to form a pattern on a cylindrical blank 600 located at a second center of process WC-2. The dies 512*a* are arranged to act on the second blank 600*a* when the longitudinal movement of the dies is in the opposite direction. The two working centers of the process are spaced apart such, and the position of the leading edges 514*a* of the dies are such that the second set of dies 512*a* functions in the same manner as explained in reference to the dies 512, except when the longitudinal reciprocal movement is in the opposite direction. As can be appreciated, when blank 600 is being loaded at center of process WC-1 a completed part is being discharged at center of process WC-2.

Referring to FIG. 11, each of the sets of dies 512 and 512*a* operate relative to a working center of process (WC) as already described with respect to the embodiment of FIGS. 1 to 7 and 8 and 9. As seen in FIG. 11, two centers of process exist in the machine of this embodiment. One, WC-1 is on transverse plane PL-1, equidistant from the leading edges 514 of dies 512 when in their fully retracted position and the another, WC-2 is on transverse plane PL-2, equidistant from the leading edge 514*a* of dies 512*a* when in their fully retracted position.

The dies of each set, designated 512 and 512*a*, are mounted in machine 500, on slidable rails 502 that longitudinally travel on bearing blocks 504, to reciprocate between a fully retracted, or loading position, represented by the set of dies 512 on the right side of FIG. 11 to a fully inserted or discharge position illustrated by the set of dies 512*a* on the left side of FIG. 11. Similarly, when the dies 512 on the right side of FIG. 11 are in the fully inserted position, the dies 512*a* are at the fully retracted position.

At the rearward extent of travel (fully retracted position) the leading edges, 514 and 514*a* of the dies 512 and 512 are spaced a distance greater than the diameter of the cylindrical pattern receiving surface of the blank 600. Thus they are spaced apart a distance sufficient to receive the cylindrical pattern receiving surface of a blank 600 in the space between the leading edges (FIG. 11, right side). At the fully inserted position of the dies, the trailing edges 516 and 516*a* of the dies 512 and 512*a* surpass each other and are spaced apart a distance sufficient to discharge a formed part (FIG. 11, left side). Thus, the length of the path of travel of each die somewhat exceeds the longitudinal length of each of the dies. Note that the illustrated reciprocating dies are oriented vertically. The blank is similarly positioned with its longitudinal axis disposed vertically. This orientation lends itself to vertical feed for loading and discharge of the blank between the reciprocating dies. Other orientation of the dies such as horizontal may also be employed.

The die faces 518 and 518*a* containing the pattern to be imparted to the cylindrical pattern receiving surface of a blank are disposed in opposed facing relation and traverse a parallel path of reciprocation between the retracted and inserted positions equidistant from and on opposite sides of vertical longitudinal plane P. The die faces 518 and 518*a* include a pattern of thread forming ridges to impart the thread form to the pattern receiving cylindrical surface of blank 600. The die faces 518 are spaced apart a distance such that with their respective leading edges positioned in face-to-face relation, the forming pattern on each die engages the outer surface of the cylindrical pattern receiving surface of the interposed blank 600.

As already explained in connection with the embodiment of FIGS. 1 to 7, the cylindrical blank 600 to be threaded is positioned with its longitudinal center line at the working center of the process WC-1 or WC-2 equidistant from the leading edge of each die of a set when the dies of a set are in the fully retracted positions. As the dies move toward the fully inserted position, the leading edges 514 or 514*a* of the die face patterns engage the outer cylindrical surface of the blank at diametrically opposite surfaces along transverse plane of contact "PL-1 or PL-2" perpendicular to longitudinal plane P and passing through the working center of process WC or WC-1.

As in the earlier embodiment, as the dies 512 or 512*a* of a die set move toward each other along the path defined by plane P, the blank 600 becomes captured between the die faces 518 or 518*a*. As the blank 600 contacts both dies it commences to rotate about its vertical center due to contact of its outer surface with the faces 518 or 518*a* of both dies of the set.

As movement of the dies 512 or 512*a* continues toward the fully inserted position, the die faces pass each other along plane P. The blank is supported by engagement with the die faces 518 and remains in a fixed location rotating about its vertical center as the dies engage its outer peripheral surface. The thread forming dies deform the peripheral surface of the pattern receiving surface of blank 600 to form the thread pattern.

The length of each die 512 or 512*a* between leading edge 514, 514*a* and trailing edge 516, 516*a* is sufficient for the blank 600 to complete four or five revolutions as is rolled between die faces. The thread form pattern on the die faces is oriented such that the pattern on a die face is displaced one hundred eighty degrees (180° relative to the other die face. This relationship is, of course, necessary to impart the appropriate deformation to the blank at diametrically opposite contact locations as the blank is rotated.

In a properly aligned relationship, the blank 600 rotates about the blank longitudinal center at the working center of the process WC-1 or WC-2 and remains longitudinally stationary relative to longitudinal plane P. If, during rolling of a thread pattern, longitudinal movement of the blank occurs, it is an indication that there is a malfunction and that unsatisfactory results are occurring.

As illustrated in FIG. 11, left side, when the dies 512 are in the fully retracted position the leading edges 514 are spaced apart a distance greater than the maximum diameter of the blank to be formed. A completed threaded component is then free to drop vertically into a collector bin below the working centers of process WC-1 and WC-2.

For purposes of positioning and retaining a blank 600 in place until contact is made by the leading edges 514 or 514*a* of the dies 512 or 512*a* with the outer cylindrical surface 601 of the blank 600 at transverse plane PL-1 or PL-2, each die 512 or 512*a* includes an upper planar surface. The size of enlarged head 602 of blank 600 is such that the blank is captured and supported by the two upper planar surfaces with the pattern receiving surface between faces 518 or 518*a*. Thus when a blank 600 is inserted (by gravity) it is vertically positioned relative to the pattern forming die faces 518 or 518*a*. A final orientation of the blank relative to the leading edges 514 or 514*a* of dies 512 or 512*a* is achieved by engagement of the blank 600 by blank delivery and positioning mechanism locating fingers seen in FIG. 11. In this regard, it is contemplated that the reciprocating die pattern forming machine 500 of FIGS. 10 to 12 includes a blank delivery and positioning mechanism associated with each working center of process, WC-1 and WC-2. Such a blank delivery and positioning mechanism could be configured as illustrated in connection with the embodiment of FIGS. 1 to 7 or could include any other suitable arrangement to unitarily and sequentially feed a headed blank 600 to the working centers of process at the appropriate time in the reciprocation cycle. As previously discussed the delivery and positioning system would be synchronized with the reciprocal movement of slide rails 502 and would be operated by the computer 509 with input from the operator control panel 511.

In addition, it is contemplated that the blank delivery and positioning mechanism would include a pair of pivotally mounted locating arms 710 with locating fingers 712 having supported facing curved ends 713. The arms 710 are mounted movement toward and away from each other as best seen in FIG. 11.

Referring to FIG. 11, right side, at center of process WC-1, when a blank 600 is delivered for pattern forming, the arms 710 pivot toward each other. The facing ends 713 of locating fingers 712 contact the outer cylindrical pattern receiving surface 601 of blank 600 and align the longitudinal centerline of the blank with the working center of process WC-1. The blank is vertically positioned relative to the die faces 518 because the enlarged head 602 of the blank 600 is supported by the upper planar surfaces of the dies 512.

The curved facing ends 713 of locating fingers 712 maintain the blank positioned relative to the center of process until the leading edges 514 of the patterned faces 518 of the dies 512 engage the cylindrical pattern receiving surface 601 of the blank 200 at diametrically opposite surfaces along transverse plane PL. The locating arms 710 are then pivoted to move locating fingers away from each other and separate the curved facing ends 713 from positioning support. As previously explained the continued axial translation of slidable rails 502 causes the dies 518 to roll the blank 600 about its longitudinal centerline to impart the thread pattern to the blank 600.

As is readily understood, the machine 500 illustrated in FIGS. 10 to 12 includes two sets of pivotal locating arms 710, one set associated with each working center of process WC-1 and WC-2. Each works identically to position a blank 600 with respect to the working center WC-1 or WC-2 to coact with the dies 512 or 512*a* at the appropriate time. Note also, that in this embodiment the pivotal support of the locating arms 710 is below the sliding rails 502, rather than being supported above the rails as shown in the embodiment of FIGS. 1 to 7.

As in the earlier embodiment the locating fingers 712 and curved facing ends 713 operate below the upper planar surfaces of the dies 512. Thus, the thickness of these components must be less than the transverse or lateral spacing between the pattern forming faces 518 of the dies.

A particular feature of the arrangement of the roll forming machine described in relation to FIGS. 10 to 12 resides in the advantageous placement of the support bearings to maximize load carrying ability. Referring to FIG. 11, the stationary bearing blocks 504 that support the slidable rails 502 are mounted on base 501 on opposite sides of longitudinal plane P in alignment with the transverse planes PL-1 and PL-2. Thus, a bearing block 504 is mounted in direct alignment with the transverse loads of the patterned die faces 518 engaging and deforming the cylindrical pattern receiving surface of the blanks 600 or 600*a*. Such bearing alignment is provided for each center of process WC-1 and WC-2. The lateral or transverse loading is transferred from the die faces 518 and 518*a* laterally through the dies 512 and 512*a* to the slidable rails 205 along the transverse plane PL-1 and PL-2. Such loading is, in turn, passed to the stationary bearing blocks 504 on base 501 by slidable rails 502.

FIG. 12 illustrates another particular advantageous feature of the reciprocal die roll forming machine 500 of FIGS. 10 to 12. As previously pointed out, the drive belts 505 and 506 are independently driven by separate servo-motors 510. The motors, therefore, can move the slidable rails 502 independently of each other. As illustrated in FIG. 12, the rails 510 can be moved such that, for example, a die set of dies 512 can be positioned so that the dies are not positioned between the bearing blocks 504. When so positioned, the structural system is sufficiently flexible to permit removal of any lodged blank from between the faces 518 of the dies 512. Similarly, the slidable rails could be axially translated in the opposite direction to move dies 512*a* from between the stationary bearing blocks 504 to permit removal of a lodged blank from between pattern forming faces 518*a*.

Also, it is noteworthy that in the embodiment of FIGS. 10 to 12 the dies 510 and 510*a* of the separate die sets are mounted on a solid, longitudinally extending slidable rail. Thus, adjustment of the longitudinal spacing and hence timing of operation of the leading edges of the dies of one die set relative to the other is readily accomplished and reliably maintained.

Another advantage of utilizing separate drive belts for each die of a set resides in the elimination of the connection between interacting dies by a toothed belt as in the embodiment of FIGS. 1 to 7. Each slidable rail 502 is pulled by a belt segment extending between the rail and the toothed drive pinion 507. Independent adjustment for belt stretch tolerance for each belt 505 and 507 can be readily accomplished with the requisite input to the controller 509 through operator input at the touch screen control panel 511.

Also, it is noteworthy that in the embodiment of FIGS. 10 to 12 the dies 510 and 510*a* of the separate die sets are mounted on a solid, longitudinally extending slidable rail. Thus, adjustment of the longitudinal spacing and hence timing of operation of the leading edges of the dies of one die set relative to the other is readily accomplished and reliably maintained.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments disclosed herein constitute a complete written description and will enable others to make and use the same. The claims are to be construed to include alternative embodiments to the extent permitted by the prior art.

The invention claimed is:

1. A method of forming a pattern on a blank having a cylindrical pattern receiving surface comprising:

providing a first pair of pattern forming dies each having a leading edge and a trailing edge and a pattern forming face mounted in facing relation for reciprocal movement between a fully retracted position and a fully inserted position on opposite sides of a longitudinal plane, positioning a longitudinal center of the cylindrical pattern receiving surface of the blank in the longitudinal plane equidistant from said leading edges of said dies, simultaneously engaging said faces of said dies with said blank at said cylindrical pattern receiving surface at diametrically opposite surfaces on the cylindrical pattern of the blank, axially translating said dies toward said fully inserted position causing the blank to rotate about its longitudinal center to impart said pattern to the cylindrical pattern receiving surface of the blank, wherein the blank remains in a fixed location while the blank rotates about its longitudinal center, and supporting said blank solely by engagement of said pattern forming faces of said dies with said pattern receiving surface of the blank during said axial translation of said dies.

2. The method of claim 1 wherein said method includes providing a mechanism to position the blank prior to engagement of said die faces with the cylindrical pattern receiving surface of the blank.

3. The method of claim 2 wherein the method further includes positioning said trailing edges of said dies a distance greater than a diameter of said cylindrical pattern receiving surface of the blank when said dies are in said fully retracted position.

4. The method of claim 3 further comprising providing a second pair of pattern forming dies each having a leading edge, a trailing edge and a pattern forming face mounted in facing relation for reciprocal movement between a fully retracted and a fully inserted position on opposite sides of said longitudinal plane, positioning a second blank with a longitudinal center of the cylindrical pattern receiving surface thereof in said longitudinal plane equidistant from said leading edges of said second pair of dies, simultaneously engaging said faces of said second pair of dies with said cylindrical pattern receiving surface of said second blank at diametrically opposite surfaces on the cylindrical pattern receiving surface of the second blank, axially translating said second pair of dies to said fully inserted position to cause said second blank to rotate about its longitudinal center to impart said pattern to the cylindrical pattern receiving surface of said second blank, and supporting said second blank by engagement of said pattern forming faces of said second pair of dies with said pattern receiving surface of the second blank during said axial translation of said second pair of dies.

5. The method as claimed in claim 4 including positioning said second pair of dies in the fully retracted position when said first pair of dies are positioned in said fully inserted position.

6. A method of forming a pattern on a blank having a cylindrical pattern receiving surface comprising:

providing a first pair of pattern forming dies each having a leading edge and a trailing edge and a pattern forming face mounted in facing relation for reciprocal movement between a fully retracted position and a fully inserted position on opposite sides of a longitudinal plane;

positioning a longitudinal center of a cylindrical pattern receiving surface of the blank in the longitudinal plane equidistant from the leading edges of the pattern forming dies;

simultaneously engaging the pattern forming faces of the pattern forming dies with the blank at the cylindrical pattern receiving surface at diametrically opposite surfaces on the cylindrical pattern of the blank;

axially translating the pattern forming dies toward the fully inserted position causing the blank to rotate about its longitudinal center to impart the pattern to the cylindrical pattern receiving surface of the blank, wherein the blank remains in a fixed location while the blank rotates about its longitudinal center; and supporting the blank by engagement of the pattern forming faces of the pattern forming dies with the pattern receiving surface of the blank during the axial translation of the pattern forming dies.

7. The method of claim 6, wherein the trailing edges of the pattern forming dies surpass each other and are spaced apart a distance sufficient to discharge the blank at the fully inserted position.

8. The method of claim 6, wherein each pattern forming die is provided with a support block longitudinally forward of the leading edge of the pattern forming die.

9. The method of claim 8, wherein the support block properly orients the blank in the longitudinal plane equidistant from the leading edges of the pattern forming dies.

10. The method of claim 6, wherein the pattern forming dies are mounted on a pair of slidable members that are movable along paths parallel to and on opposite sides of the longitudinal plane.

11. The method of claim 10, wherein a drive mechanism for the slidable members reciprocates the pattern forming dies between the fully retracted position and the fully inserted position.

12. The method of claim 11, wherein the drive mechanism comprises at least one drive belt operatively connected to the pair of slidable members, and at least one servo-motor arranged to reciprocate the pair of slidable members to move the pattern forming dies between the fully retracted position and the fully inserted position.

13. The method of claim 6, wherein the pattern on the blank is formed upon completion of the step of axially translating the pattern forming dies from the fully retracted position to the fully inserted position.

14. The method of claim 6 further comprising providing a second pair of pattern forming dies each having a leading edge, a trailing edge and a pattern forming face mounted in facing relation for reciprocal movement between a fully retracted position and a fully inserted position on opposite sides of the longitudinal plane;

positioning a second blank with a longitudinal center of the cylindrical pattern receiving surface thereof in the longitudinal plane equidistant from the leading edges of the second pair of pattern forming dies;

simultaneously engaging the pattern forming faces of the second pair of pattern forming dies with the cylindrical pattern receiving surface of the second blank at diametrically opposite surfaces on the cylindrical pattern receiving surface of the second blank;

axially translating the second pair of pattern forming dies to the fully inserted position to cause the second blank to rotate about its longitudinal center to impart the pattern to the cylindrical pattern receiving surface of the second blank; and supporting the second blank by engagement of the pattern forming faces of the second pair of pattern forming dies with the pattern receiving surface of the second blank during the axial translation of the second pair of pattern forming dies.

15. A method of roll forming a cylindrical blank comprising:

providing a first pair of pattern forming dies each having a leading edge and a trailing edge and a pattern forming face mounted in facing relation for reciprocal movement between a fully retracted position and a fully inserted position on opposite sides of a longitudinal plane;

positioning a longitudinal center of the blank in the longitudinal plane equidistant from the leading edges of the pattern forming dies;

simultaneously engaging the pattern forming faces of the pattern forming dies with the blank at diametrically opposite surfaces of the blank;

axially translating the pattern forming dies toward the fully inserted position causing the blank to rotate about its longitudinal center to impart the pattern on the blank, wherein the blank remains in a fixed location while the blank rotates about its longitudinal center;

supporting the blank by engagement of the pattern forming faces of the pattern forming dies with the blank during the axial translation of the pattern forming dies; and releasing the blank from the pattern forming faces of the pattern forming dies when the pattern forming dies reach the fully inserted position.

16. The method of claim 15, wherein the blank drops vertically below the pair of pattern forming dies along the longitudinal center of the blank when the blank is released.

17. The method of claim 15, wherein the method includes providing a mechanism to position the blank by gravity prior to engagement of the pattern forming faces of the pattern forming dies on the blank.

18. The method of claim 15, wherein the blank remains in a fixed location rotating about the longitudinal center during the step of axially translating the pattern forming dies toward the fully inserted position.

19. The method of claim 15, further comprising providing a second pair of pattern forming dies each having a leading edge, a trailing edge and a pattern forming face mounted in facing relation for reciprocal movement between a fully retracted position and a fully inserted position on opposite sides of the longitudinal plane;

positioning a second blank with a longitudinal center in the longitudinal plane equidistant from the leading edges of the second pair of pattern forming dies;

simultaneously engaging the pattern forming faces of the second pair of pattern forming dies with the second blank at diametrically opposite surfaces of the second blank;

axially translating the second pair of pattern forming dies to the fully inserted position to cause the blank to rotate about its longitudinal center to impart the pattern on the second blank; and supporting the second blank by engagement of the pattern forming faces of the second pair of pattern forming dies with the second blank during the axial translation of the second pair of pattern forming dies.

20. The method of claim 19, further including the step of positioning the second pair of pattern forming dies in the fully retracted position when the first pair of pattern forming dies are position in the fully inserted position.

* * * * *